US005115524A

United States Patent [19]

Antosko

[11] Patent Number: 5,115,524

[45] Date of Patent: May 26, 1992

[54] FOLDING CRIB MODE FROM CARDBOARD MATERIAL

[76] Inventor: H. B. Antosko, 16 Harrow Place, Beaconsfield, Quebec, Canada, H9W 5C7

[21] Appl. No.: 599,451

[22] Filed: Oct. 5, 1990

Related U.S. Application Data

[63] Continuation-in-part of Ser. No. 464,793, Dec. 20, 1989, abandoned.

[51] Int. Cl.[5] ..... A47D 7/00; B65D 5/10

[52] U.S. Cl. ..... 5/99.1; 5/94; 229/117.06; 229/117.17; 229/103

[58] Field of Search ..... 5/94, 99.1, 417; 190/2; 229/103, 117.05, 117.06, 117.07, 117.12, 117.16, 117.17

[56] References Cited

U.S. PATENT DOCUMENTS

| | | | |
|---|---|---|---|
| 738,518 | 9/1903 | Beers | 229/117.07 X |
| 2,303,996 | 12/1992 | Hirsch | 229/117.07 X |
| 2,548,252 | 4/1951 | Bergstein | 229/117.07 |
| 2,950,484 | 8/1960 | Jaffe | 229/117.07 X |
| 2,980,310 | 4/1961 | Arneson | 229/117.07 X |
| 3,162,350 | 12/1964 | Miller | 229/117.12 |
| 3,275,215 | 9/1966 | Paige | 229/117.17 X |
| 3,314,493 | 12/1963 | Dunkin | 229/117.17 X |
| 3,336,608 | 8/1967 | Lerner | 5/99.1 |
| 3,487,479 | 1/1970 | Grooms | 5/99.1 X |
| 3,531,041 | 9/1970 | Rohdl | 229/117.12 |
| 3,844,471 | 10/1974 | Hind | 5/99.1 X |

FOREIGN PATENT DOCUMENTS

| | | | |
|---|---|---|---|
| 133498 | 1/1948 | Australia | 5/94 |
| 599108 | 3/1948 | United Kingdom | 5/99.1 |
| 887810 | 1/1962 | United Kingdom | 5/99.1 |

*Primary Examiner*—Michael F. Trettel

[57] ABSTRACT

A light-weight, compact, portable knock-down crib comprised of a single flat sheet of foldable material having an integrally formed rectangular base. A pair of side wall and end wall panels are foldable on folding score lines about the base. Attachment tabs and slots are provided to interlock the panels elevated transversely from the base in a position of use to form an open-top enclosure. Collapsing folding score lines extend transversely across the flat sheet and centrally align with the pair of side wall panels. The panels are foldable on the rectangular base and the flat sheet is folded into a hand-portable package.

19 Claims, 5 Drawing Sheets

FOLDING CRIB MODE FROM CARDBOARD MATERIAL

This is a Continuation-In-Part application of U.S. application Ser. No. 464,793 filed Dec. 20, 1989, now abandoned.

BACKGROUND OF INVENTION

1. Field of the Invention

The present invention relates to a light-weight, compact portable knock-down crib formed of a single cardboard blank or other suitable foldable material and wherein the blank is provided with an array of folding lines to permit the crib to be folded into a collapsed hand-portable package or a box-like crib.

2. Description of Prior Art

Various portable collapsible crib assemblies are known. For example, reference is made to U.S. Pat. No. 3,336,608 which discloses such a collapsible crib made of a flexible plastic skin material and defines side walls and end walls which are attached together by snap fasteners to maintain the crib in a position of use or in a hand-portable package. It is also known from U.S. Pat. No. 3,487,479 to provide a crib assembly which is made partly from cardboard material to form a box to hold a container and partition walls therein, all of which are constructed from several blanks of cardboard material which are assembled together. A disadvantage of this latter crib assembly is that it comprises many parts which can easily be broken or lost thereby rendering the entire crib assembly inefficient for its intended use. Also, it is difficult to transport such crib assembly in its knock-down condition because of the many parts, and therefore it is preferable to maintain it in its assembled condition during periods of use or non-use.

SUMMARY OF INVENTION

It is an object of the present invention to provide an improved light-weight, compact portable knock-down crib which provides advantages over the prior art to overcome the problems referred to above.

Another object of the present invention is to provide a light-weight, compact portable knock-down crib which is formed of cardboard material treated with a fire retardant solution and/or a water-proof solution.

According to another object of the present invention, there is provided a light-weight, compact portable knock-down crib which is provided with collapsible folding means extending transversely and central in the base and the side walls with the side walls being further provided with diagonal fold lines to permit the side walls and end walls to fold together on the rectangular base and then for the base to be folded in half into a hand-portable package.

Still another object of the present invention is to provide a light-weight, compact portable knock-down crib which is constructed of a single flat blank of cardboard material and wherein a collapsible folding means, including at least one expandable joint, permits the blank to be folded into a hand-portable package of small size.

According to the above objects, from a broad aspect, the present invention provides a light-weight, compact, portable knock-down crib comprising a single flat sheet of foldable material having an integrally formed rectangular base. A pair of side wall and end wall panels are foldable on folding score lines about the base. Attachment means is provided to secure the panels to one another. Means is provided to retain the end panels elevated from the base when in a position of use to form an open-top enclosure. Collapsible folding means is disposed in the base and the side wall panels to permit the side walls and end walls to fold together on the rectangular base and further to permit the flat sheet and folded panels to be folded to form a hand-portable package.

According to a further broad aspect of the invention, the collapsible folding means comprises a pair of spaced apart parallel score lines extending transversely across the rectangular base and the side wall panels. Wall folding means is provided in the side wall panels to permit the side walls and end walls to fold together on the rectangular base.

According to a still further broad aspect of the invention, there is provided a light-weight, compact portable knock-down crib which is comprised of a single flat sheet of foldable material having an integrally formed rectangular base. A pair of side wall and end wall panels are foldable on folding score lines about the base. Attachment means is provided to interlock the panels elevated from the base in a position of use to form an open-top enclosure. Collapsible folding means extend transversely across the sheet and centrally aligned with the pair of side wall panels. The collapsing folding means includes at least one expandable joint in at least part of each of the side wall panels to permit sections of the side wall panels to move in response to folding pressure so that the flat sheet end panels will give to folding pressure to form a hand-portable package.

BRIEF DESCRIPTION OF DRAWINGS

The present invention will now be described with reference to the examples thereof as illustrated in the accompanying drawings in which:

FIG. 8 is a fragmented perspective view showing the attachment between the side walls and end walls and the wall folding diagonal score lines.

DESCRIPTION OF PREFERRED EMBODIMENTS

Figure 1:
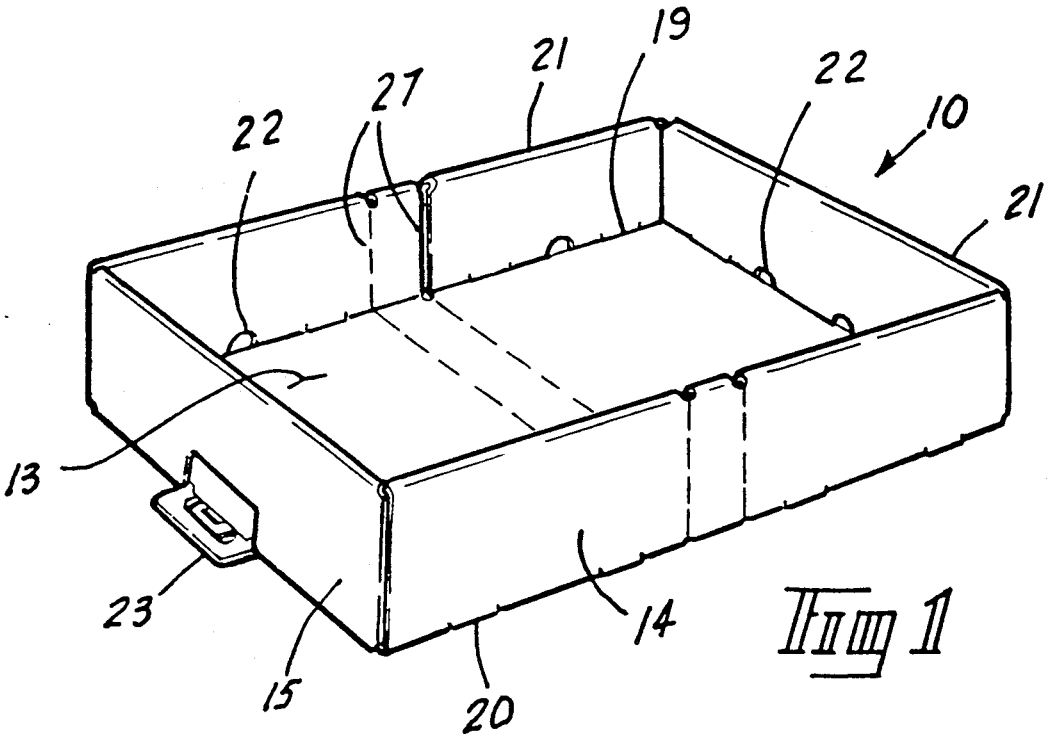
FIG. 1 is a perspective view of the portable knock-down crib in its condition of use.
Figure 2:
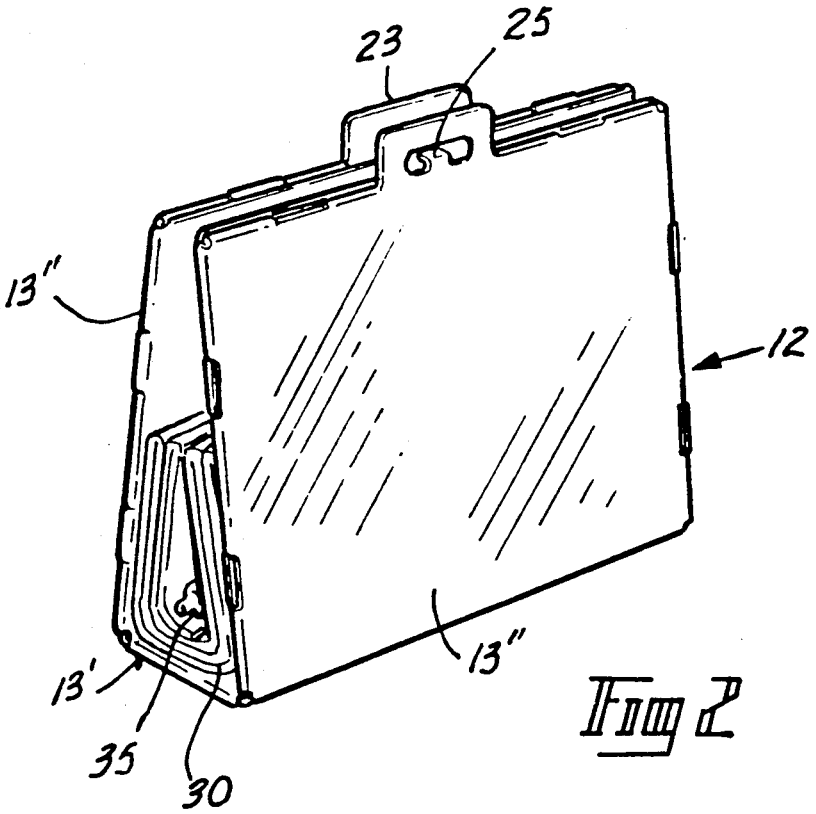
FIG. 2 is a perspective view of the crib when folded into a hand-portable package in its condition of non-use.
Figure 3:
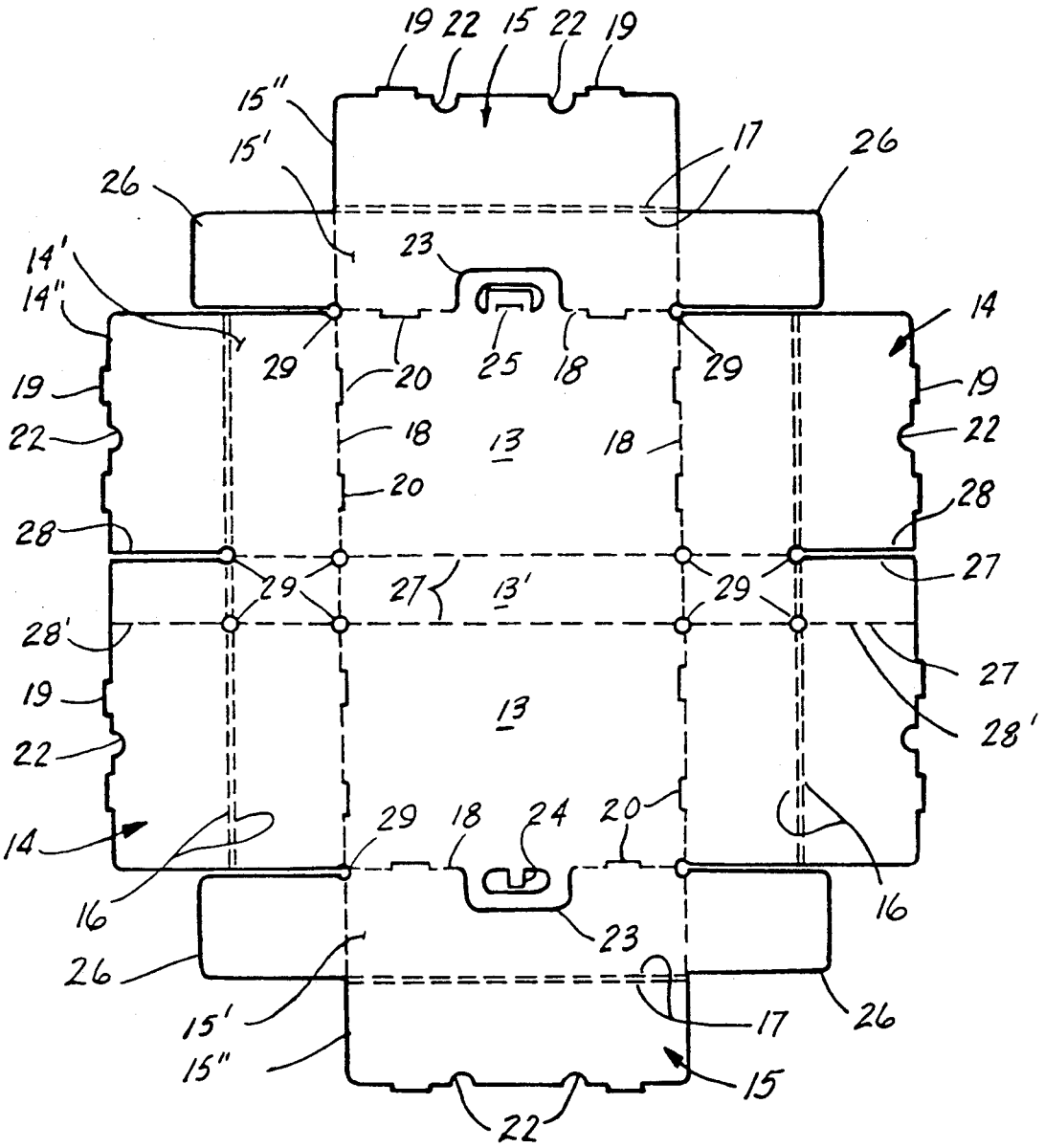
FIG. 3 is a plan view of the blank forming the portable knock-down crib of the present invention.

Referring now to the drawings, and more particularly to FIGS. 1 to 3, there is shown the light-weight, compact, portable knock-down crib 10 of the invention. The crib 10 is constructed from a single flat sheet 11 of foldable material such as cardboard, corrugated cardboard or cardboard impregnated with a fire-retardant solution or a water-proof solution. The blank sheet 11 can be folded to constitute the crib 10 as shown in FIG. 1 or to constitute the hand-portable package 12 as shown in FIG. 2.

Referring now more particularly to FIGS. 1 and 3, it can be seen that the blank defines a rectangular base 13, side walls 14 and end walls 15. The side walls and end walls are each formed of an inner and outer rectangular section 14', 14" and 15', 15", respectively. An intermediate score line 16 is disposed between the inner and outer side wall panels 14' and 14". A further intermediate score line 17 is provided between the inner and outer end panels 15' and 15" whereby these panels can be folded over each other and about folding score lines 18 disposed all about the rectangular base 13. One or more retention tabs 19 extend outwardly from the outer elongated edges of the outer rectangular panels 14" and 15" to engage in aligned retention slots 20 formed on the rectangular base 13 adjacent the folding score line 18 so that when the outer rectangular sections 14" and 15" are folded over the inner rectangular sections 14' and 15', respectively, the side walls and end walls are retained vertically to one side of the base 13. The intermediate score lines 16 and 17 are double score lines as shown at 17' whereby to provide an outer peripheral edge 21 (see FIG. 1), which is flat whereby to provide a smooth surface to prevent an infant from cutting or scratching himself on the edges when positioned in the crib. Cutouts 22 are also provided in the outer edges of the outer sections 14" and 15" to provide a finger grip to facilitate removing the tabs 19 from the slots 20 when disassembling the crib in its condition of use, as shown in FIG. 1. By simply inserting the finger in these cutouts 22, the panels can easily be pulled outwards.

Handle members 23 are also cut in the inner rectangular sections 15' of the end panels 15 in such a way that the handle members protrude from the hand-portable package when folded to its condition of non-use, as shown in FIG. 2. A connecting means in the form of a tab 24 and a tab receiving slot 25 are also formed in the handle grip section to maintain the cardboard blank in its hand-portable package 12, as shown in FIG. 2.

As can be seen in FIG. 3, the blank 11 also comprises interlocking wings 26 which are formed as extensions of the inner sections 15' of the end walls 15 to interlock with the side walls 14. It is preferable to have these wings 26 in the end walls as they can be made longer to fit between the folded over sections of the inner and outer sections 14' and 14" of the adjacent side wall panels 14. If the wings were in the side wall panels, they would have to be of a shorter length due to the fact that the handle grip 23 is provided in the end wall panels. As herein shown, the handle member is a U-shaped strip formed by two parallel rows of score lines.

In order to form the portable package 12 as shown in FIG. 2, there is provided collapsing folding means in the form of two transverse parallel score lines 27 extending entirely across the blank 11 from the outer edges of the side walls 14. Also, in order to permit the outer sections 14" of the side wall panels to move or flex in response to the folding pressure of the overlaid cardboard end walls and side walls, at least one expandable joint 28 in the form of a slit is made from the outer edges of the side wall panels 14" and extending to the intermediate fold lines 16 and 17. These slits 28 may also be formed in the other fold line 28' to provide added ease of folding the blank into the portable package shown in FIG. 2. Holes 29 are also formed at strategic junctions of some of the score lines to also facilitate folding and to prevent tearing of the cardboard. The spaced apart parallel package forming score lines 27 also define the base 13' of the package 12 and is of sufficient width to permit the positioning of a mattress pad 30 within the package 12. This mattress pad 30 is preferably comprised of a light-weight pad of soft material dimensioned to fit on top of the base 13. As herein shown, the mattress is formed from a plastic pad having air pockets therein isolated on the outer surfaces by a protective outer sheet. It could also consist of a foam sheet or a laminated foam pad.

The blank of FIG. 3 is folded to form the crib as shown in FIG. 1 in the following manner. Firstly, the wings 26 are bent inwardly over the base 13 with the inner section 15' of the end wall 15 lifted vertically. The outer section 15" is then folded down with the tabs 19 entering the slots 20. The side wall outer sections 14" are then folded on the intermediate score line 16 with the wings 26 captive thereunder and with the inner section 14 extending vertically. The tabs 19 also are secured within their respective slots 20. The crib of FIG. 1 is thus formed.

Figure 4:
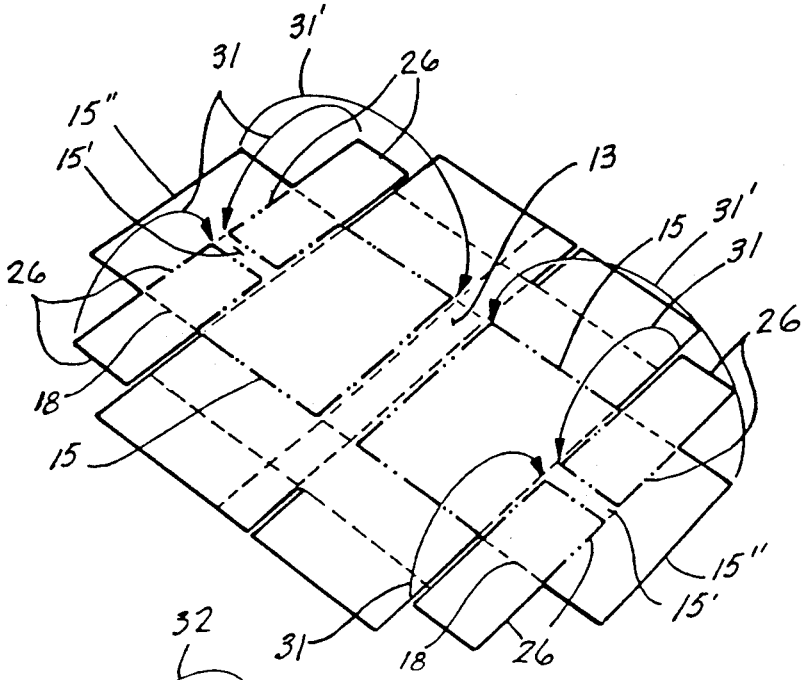
FIGS. 4 to 6 are simplified plan views of the blank showing the sequence of folding the blank to form the hand-portable package of FIG. 2.
Figure 5:
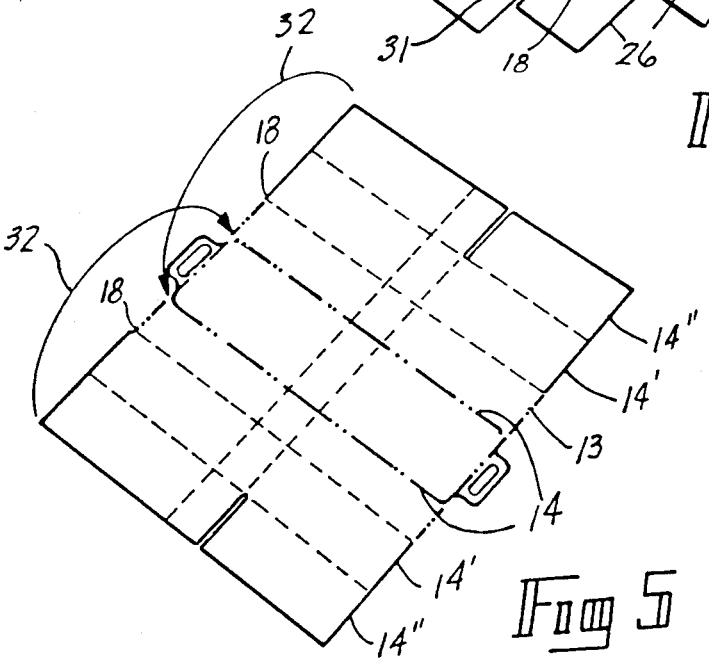
Figure 6:
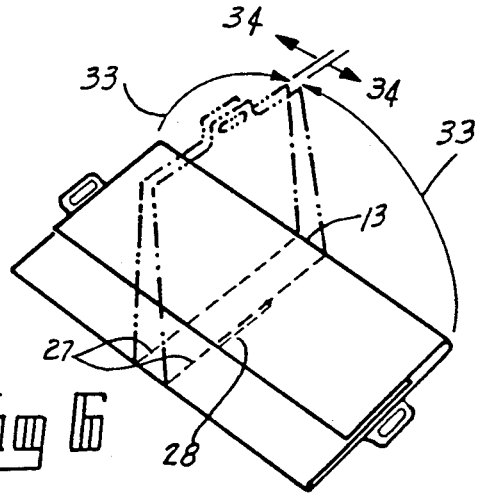
Figure 7:
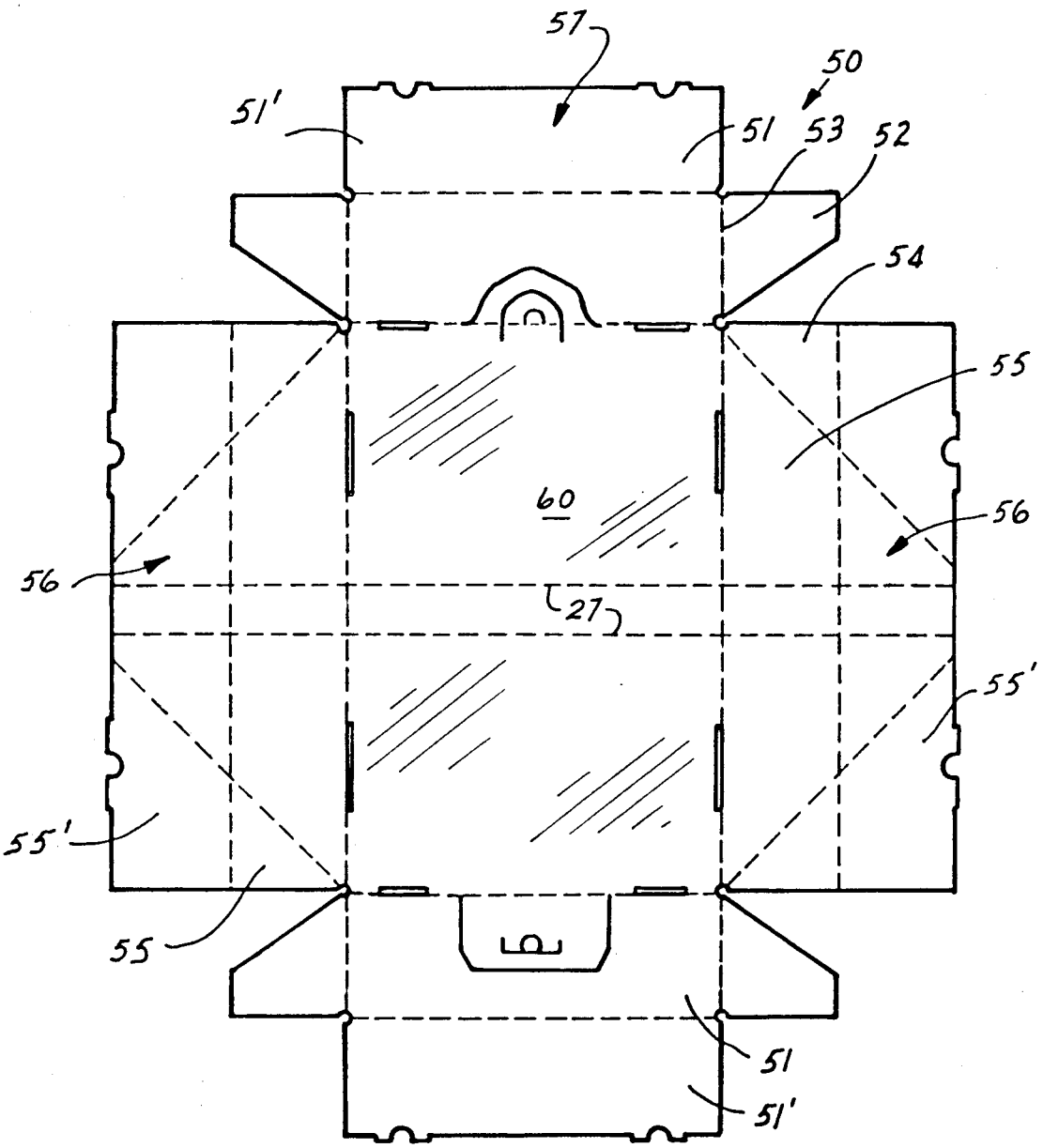
FIG. 7 is a plan view of the blank, similar to FIG. 3, but showing a further embodiment of the portable knock-down crib of the present invention.

The crib is dismantled by undoing the end walls and side walls by pulling on the cutouts 22 to disengage the tabs 19 from their slots 20. With the blank folded out as shown in FIG. 3, the wings 26 are then folded over the inner section 15' of the end walls 15 and the inner and outer sections 15' and 15" are folded over the adjacent section of the base 13 as shown by the arrows 31 and 31' respectively, in FIG. 4. The side wall sections 14' and 14" as shown in FIG. 5, are then folded over the end wall sections 15' and 15" in the direction of the arrow 32 as shown in FIG. 5. The two base panels 13" are then folded towards one another in the direction of arrows 33 to a respective side of the base section 13'. When this is done, the outer side wall sections 14" will flex outwardly or be forced outwardly in the direction of arrows 34, this being due to the slits 28 and/or 28' formed in the outer sections 14" of the side walls 14. These slits 28 and 28' eliminate the resisting force that would otherwise exist if such had not been provided and this would continuously place an outward pressure on the panels 13" of the package and against the attachment tab 25 causing the folded package to be unstable and to deform. This is particularly so when the mattress 30 is positioned within the cavity formed between the base wall 13' and side walls 13". A nursing bottle or other articles or toys can also be stored in this area, as shown at 35.

Referring now to FIGS. 7 to 11, there is illustrated a further embodiment of the construction of the portable knock-down crib of the present invention. The modified blank 50 as illustrated herein is designed whereby the inner rectangular end panels 51 are provided with wings 52 on opposed vertical edges 53 which are scored whereby the wings 52 may be glued or otherwise fastened to the inside surface 54 of the inner elongated rectangular panel 55 of the side wall 56. Thus, the inner rectangular panels 51 and 55 are secured in a inner rectangular panels 51 and 55 are secured in a vertical plane in relation to the base 60 so as to form a box.

Referring now additionally to FIG. 8, there is shown a perspective view of the box with the inner rectangular panel sections 51 and 55 secured together by the wings 52. In order to permit the side walls 56 and end walls 57 to fold together on the rectangular base 60, the side wall 56 is provided with wall folding means in the form of opposed diagonal fold lines 58 extending from opposed ends of its panel folding line 59 along its base and extending to an opposed side of the transverse parallel score lines 27 as previously described with the previous embodiment. In order to permit proper folding of the side walls onto the rectangular base 60, the wings 52 are only glued in the hatched portion 61 which lies above the diagonal fold line 58 on the inner rectangular section 51 of the side wall. Accordingly, with this embodiment, when the package is opened to its position as shown in FIG. 8, all that is necessary to form the crib in its usable state is to fold the outer elongated rectangular sections 55' and 51' over their inner rectangular sections 55 and 51, respectively, as illustrated by arrows 62. Thus, the crib is very easy to form.

Figure 9:
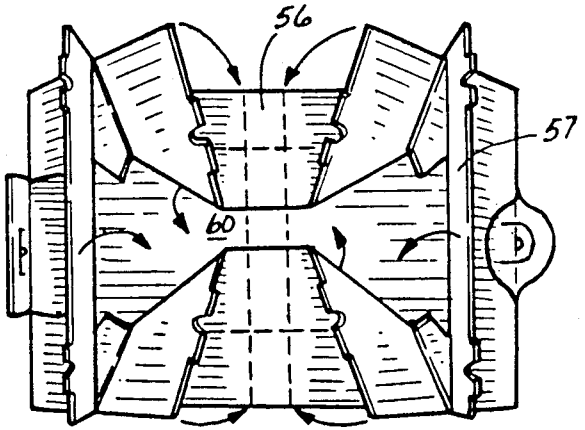
FIGS. 9, 10 and 11 are simplified plan views of the crib illustrating the folding sequence thereof to form the hand-portable package of FIG. 2.
Figure 11:
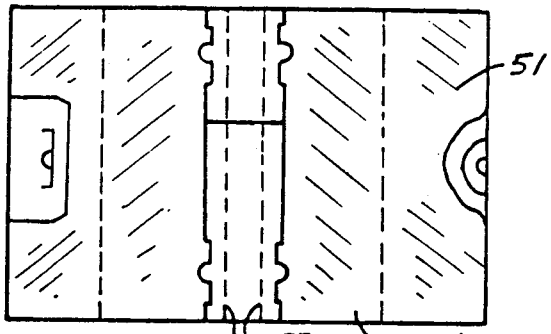
Figure 10:
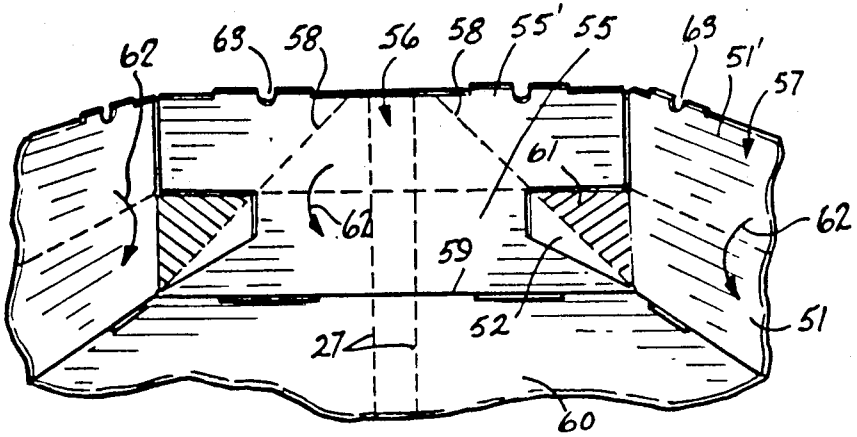
Figure 10:
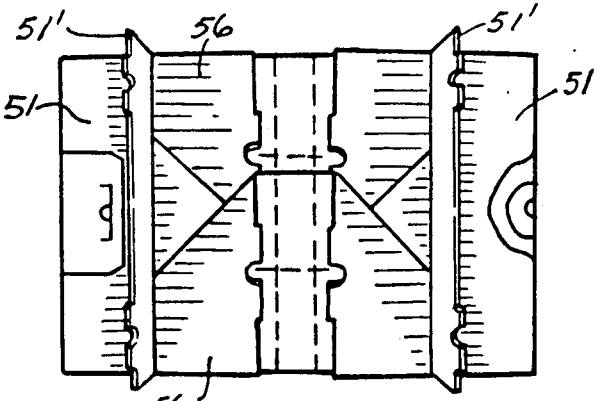

Referring now to FIGS. 9 to 11, there is shown briefly the sequence to fold the usable crib to its hand-portable state as shown in FIG. 2. Firstly, the outer rectangular sections 55' and 51' are retracted to their position as shown in FIG. 8 by pulling on the cutouts 63 and the side wall panels 56 are then pulled down centrally between the diagonal fold lines 58 to lie one on top of another on the base 60, as illustrated in FIG. 9. This causes the side walls to fold in and, at the same time, to draw the end walls 57 thereover, as indicated by the arrows in FIG. 9. FIG. 10 illustrates the side walls 56 in their folded over condition as well as the end walls 57 with the outer rectangular sections 51' being opened to show the position of the folded side walls. FIG. 11 shows the side walls fully folded over the base wall with the blank now being ready to be folded on the diagonal pair of transverse fold lines 27 to form the package of FIG. 2.

Another advantage of the crib structure of the invention is that the handle members 23 are provided in the lower portion of the end wall when assembled in its position of use as shown in FIG. 1. In this position, the crib can be used as a storage bin which is disposed under a bed and can be easily pulled out from under the bed by grasping the handle, which is readily available. The handle can also constitute a tie-down for the crib in order to prevent it from movement on a support surface. The crib may also be constructed of a plastic corrugated blank or other suitable material that is foldable. Still further, the material may be sprayed with a baby powder scent.

I claim:

1. A light-weight, compact, portable knock-down crib comprising a single flat sheet of foldable material having an integrally formed rectangular base, a pair of side wall and end wall panels foldable on folding score lines about said base, attachment means to secure said panels to one another, means to retain said panels elevated from said base when in a position of use to form an open-top enclosure, collapsing folding means disposed in said base and said side wall panels to permit said side walls and end walls to fold together on said rectangular base and further permitting said flat sheet and folded panels to be folded to form a hand-portable package, said collapsing folding means being comprised by a pair of spaced-apart parallel score lines extending transversely across said rectangular base and said side wall panels, and wall folding means in said side wall panels to permit said side walls and end walls to fold together on said rectangular base.

2. A crib as claimed in claim 1 wherein said attachment means is a wing formed in an end edge of said side wall or end wall panels and secured to an inside surface of the adjacent side wall or end wall to form a box-like structure.

3. A crib as claimed in claim 2 wherein said wall folding means is constituted by opposed diagonal fold lines in said side walls and extending from opposed ends of its said folding score line about said base and extending to an opposed side of said collapsing folding means and terminating at a top edge of said side walls.

4. A crib as claimed in claim 3 wherein said side wall and end wall panels each have an inner and outer elongated rectangular section with an intermediate score line therebetween, one or more retention tabs extending outwardly from a top of said outer section, one or more tab retention slots formed on said rectangular base adjacent said folding score line of each panel and aligned with said one or more retention tabs so that said outer rectangular section when folded over said inner rectangular section on said intermediate score line toward said rectangular base may be retained rigid in a transverse plane to said base by locating said one or more tabs in said one or more slots.

5. A crib as claimed in claim 4 wherein said wings are provided integral with an end edge of said inner elongated rectangular section of said end walls, said wings being glued to an inner surface of said outer elongated rectangular sections of said side walls in an area above said diagonal fold lines.

6. A crib as claimed in claim 5 wherein said wings have a diagonal lower edge extending from said foldable score line of said end wall to permit said side walls and end walls to fold together on said rectangular base.

7. A crib as claimed in claim 3 wherein a handle member is scored in said inner rectangular section of said end wall panels at a predetermined location so that said handle member protrudes from said hand-portable package when said flat sheet is folded to form said hand-portable package.

8. A crib as claimed in claim 3 wherein said flat sheet is a blank formed from cardboard material having a water-proof coating on at least one surface thereof.

9. A crib as claimed in claim 3 wherein said flat sheet is a corrugated cardboard blank coated with a fire-retardant solution and wherein a light-weight pad of deformable material is dimensioned to fit on said base, said pad having a protective outer sheet and foldable for storage between folded half-portions of said flat sheets when folded to said hand-portable package.

10. A light-weight, compact, portable knock-down crib comprising a single flat sheet of foldable material having an integrally formed rectangular base, a pair of side wall and end wall panels foldable on folding score lines about said base, attachment means to interlock said panels elevated from said base in a position of use to form an open-top enclosure and collapsing folding means extending transversely across said flat sheet and centrally aligned with said pair of side wall panels, said collapsing folding means including at least one expandable joint in at least part of each said side wall panels to permit sections of said side wall panels to move in response to folding pressure so that said flat sheet and panels may be folded into a hand-portable package.

11. A crib as claimed in claim 10 wherein said side wall and end wall panels each have an inner and outer elongated rectangular section with an intermediate score line therebetween, one or more retention tabs extending outwardly from an outer elongated edge of said outer section, one or more tab retention slots formed on said rectangular base adjacent a folding score line and aligned with said one or more retention tabs so that said outer rectangular section when folded over said inner rectangular section on said intermediate score line toward said rectangular base may be retained in a transverse plane to said base by locating said one or more tabs in said one or more slots, said collapsing folding means being two parallel score lines extending transversely across said flat sheet.

12. A crib as claimed in claim 11 wherein a handle member is scored in said inner rectangular section of said end wall panels at a predetermined location so that said handle member protrudes from said hand-portable package when said flat sheet is folded to form said hand-portable package.

13. A crib as claimed in claim 12 wherein said handle member is a U-shaped strip formed by two parallel rows of score lines provided in said end wall panel area, said handle member protruding from an upper edge of said hand-portable package, and lock tabs associated with said handle members.

14. A crib as claimed in claim 11 wherein said flat sheet is a blank formed from cardboard material, said expandable joint being constituted by a slot extending into said outer rectangular section along one of said two parallel score lines which extend transversely across said flat sheet.

15. A crib as claimed in claim 11 wherein said flat sheet is a blank formed of corrugated cardboard having a water-proof coating on at least one surface thereof.

16. A crib as claimed in claim 11 wherein one of said inner elongated rectangular sections of said side walls or end walls is provided with opposed wall interlocking wings formed integral therewith and foldable on a transverse fold line so as to be positioned intermediate said inner and outer elongated rectangular sections of said other adjacent rectangular sections when folded to their position of use.

17. A crib as claimed in claim 16 wherein said interlocking wings and said retention tabs constitute said attachment means to interlock said panels, said intermediate score line being a double parallel score line to form a flat side wall top edge.

18. A crib as claimed in claim 11 wherein there are two spaced-apart retention tabs on said elongated edge of each of said outer sections and two aligned tab retention slots in alignment with said tabs adjacent said folding score lines and a pair of spaced-apart parallel package forming score lines extending across a mid-section of said flat sheet of foldable material, said parallel package forming score lines delineating a rectangular base for said hand-portable package, said side wall and end wall panels being folded inwardly of said package.

19. A crib as claimed in claim 11 wherein said flat sheet is a corrugated cardboard blank coated with a fire-retardant solution and a light-weight pad of deformable material dimensioned to fit on said base, said pad being a plastic pad having air pockets, said pad having a protective outer sheet and foldable for storage between folded half-portions of said flat sheets when folded to said hand-portable package.

* * * * *